United States Patent [19]

Jarrett

[11] Patent Number: 4,512,326

[45] Date of Patent: Apr. 23, 1985

[54] COMPOUND LEVER BOW

[76] Inventor: David W. Jarrett, 901 Sunset Dr., Lexington, Va. 40502

[21] Appl. No.: 370,036

[22] Filed: Apr. 20, 1982

[51] Int. Cl.[3] ..... F41B 5/00

[52] U.S. Cl. ..... 124/23 R; 124/DIG. 1

[58] Field of Search ..... 124/23 R, 24 R, 90, 124/25, 80, 6, 7, 8, DIG. 1

[56] References Cited

U.S. PATENT DOCUMENTS

| | | | |
|---|---|---|---|
| 3,851,638 | 12/1974 | Alexander | 124/24 R |
| 3,967,609 | 7/1976 | Frydenlund | 124/90 X |
| 3,989,026 | 11/1976 | Nishioka | 124/24 R |
| 4,368,718 | 1/1983 | Simmonds et al. | 124/23 R |

*Primary Examiner*—Richard J. Apley
*Assistant Examiner*—William R. Browne
*Attorney, Agent, or Firm*—Charles R. Engle

[57] ABSTRACT

A compound lever bow including oppositely extending rigid limbs each rotatably supporting lever mechanisms. A pair of flexible limbs are secured to the bow overlying respective rigid limbs. A bowstring is connected to each of the lever mechanisms. Also a separate force cable is connected between each terminal end of the flexible limbs and respective lever mechanisms. The lever mechanisms each are provided with a stop limiting rotation thereby preventing an over-center condition. The lever mechanisms include pulleys receiving a synchronizing cable evenly distributing pull forces on the bowstring to the ends of the rigid limbs. The bowstring connections, the force cable connections and the lever mechanism pivot points are placed to provide a second class lever mechanical advantage. Rotation of the lever mechanisms to place the cable connecting points and the lever mechanisms pivot points in a near straight position reduces the shooting-hold force to near zero. The magnitude of the shooting-hold force is variably regulated by adjustment of the stop.

4 Claims, 6 Drawing Figures

COMPOUND LEVER BOW

BACKGROUND OF THE INVENTION

While compound bows have been a development of relatively recent times there are many disadvantages remaining with the improvement over conventional simple bow structures including the bow string being attached to each end of a flexible bow member. A compound bow structure does permit a reduction in pull force so that the archer can more accurately aim the bow because the reduction in tension permits a more steady holding of the bow. The advantageous aspect of a compound bow structure is that it permits the storage of energy into the bow structure thereby limiting the amount of force necessary for the archer to hold the bowstring in the fully pulled position. As an example if a bow requires a draw-force of 80 lbs. the archer must be able to pull the bow string with an 80 lb. force and in a conventional bow he would be required to sight the bow while holding the string against such a force. A presently known compound bow structure having a full force of 60 lbs. would likely require a pull force of approximately 30 lbs. in the shooting position. Obviously this is a significant advantage to the archer in his effort to maintain the bow steady while aiming at a target.

A problem prevalent in the use of compound bows, however, is the accidental breakage of the bow by an overly enthusiastic archer. This problem results from the fact that the bow limbs of a compound bow are generally relatively short and stiff as compared to the limbs of a standard bow having substantial length. The shorter and stiffer limbs are more susceptible to breakage when the archer is supplied with a particular mechanical advantage in pulling the bow string to the drawn position.

SUMMARY OF THE INVENTION

In view of the desirability of providing a bow structure having maximum energy storing capabilities in combination with a provision of a structure that will not likely break during its normal use I have provided a compound lever bow structure. The compound lever bow structure of my invention provides a predetermined mechanical advantage such that when drawn toward the hold position the pull force approaches a zero magnitude. A stop member is provided to prevent drawing the bowstring into an over-center position rendering the bow inoperable. This stop member can be adjustable permitting the final pre-determined pull force applied to the archer while in the shooting position to be of a pre-determined magnitude as low as 2 to 6 lbs.

The structure of my invention, providing the aforementioned advantages, is relatively simple and easy to manufacture and consequently is very reliable in its operation.

These advantageous features are accomplished through the provision of a rigid handle and two angularly extending rigid limbs each supporting rotatable lever mechanisms at their terminal ends. Flexible limbs are secured to the handle and extend in an overlying relationship in back of the rigid limbs and are connected to the respective lever mechanisms through force cables. Synchronizing pulleys are either attached to or are integral with the lever mechanisms so that they rotate with the levers on their pivot points at the ends of the rigid limbs. A synchronizing cable is placed upon each of the pulleys so that the pulleys rotate in unison. A bow string is connected to pre-determined connecting points on each of the levers at a specified distance from the rotating pivotal point of the pulleys and the levers providing a second class lever mechanical advantage. Consequently a pull on a bowstring results in the levers being rotated in unison thereby evenly dividing the pull force on each of the force cables of the flexible limbs as the bowstring is drawn to its shooting-hold position. As previously mentioned the force cables are connected at points a pre-determined distance away from the pivotal point of the levers resulting in a specified mechanical advantage during the pull of the bowstring to the shooting position. Consequently the pull force will rise to a maximum when the bowstring is pulled approximately mid-way toward the shooting-hold position and the force will decrease as the bowstring is further pulled to the hold position wherein the levers are rotated against the stop means regulating the hold force at a magnitude of, for example, to 2 to 6 lbs. holding force. The stop means is obviously necessary to prevent the lever from rotating to an over-center position resulting in a collapse of the bow structure preventing shooting of the arrow.

DESCRIPTIONS OF THE DRAWING

DETAILED DESCRIPTION

Figure 1:
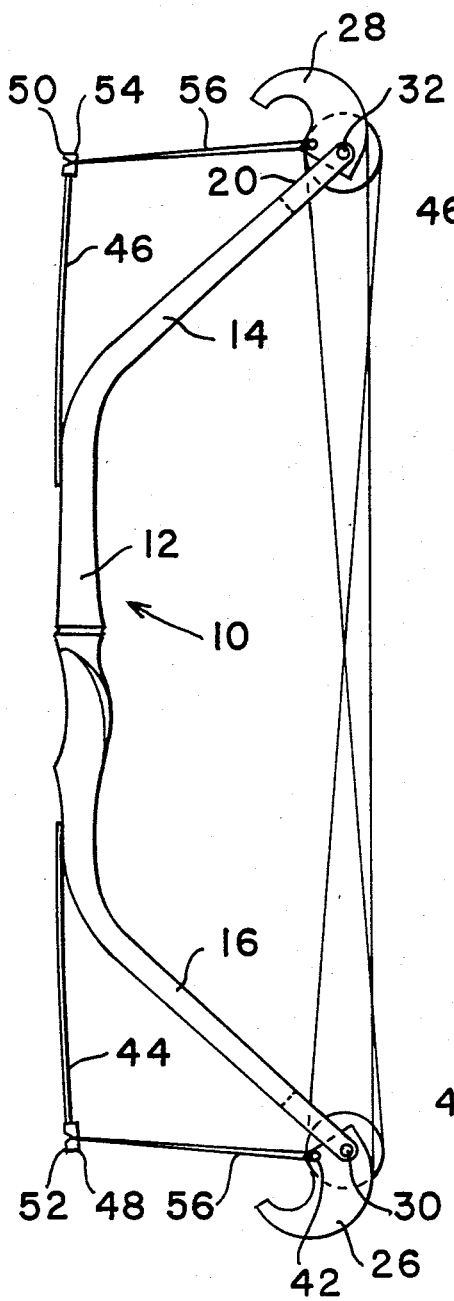
FIG. 1 is a side elevational view of my compound lever bow in a relaxed position.

Referring to FIG. 1, my compound lever bow 10 includes a handle section 12 and rigid limbs 14 and 16. The rigid limbs 14 and 16 are either milled out or cast to include cavities 18 and 20 defined by side portions 22 and 24 on each of the rigid limbs so that lever assemblies 26 and 28 may be rotatably received therein. The lever assemblies 26 and 28 are rotatably mounted upon bearing structures 30 and 32 placed in appropriate apertures in the rigid limbs 14 and 16.

Figure 4:
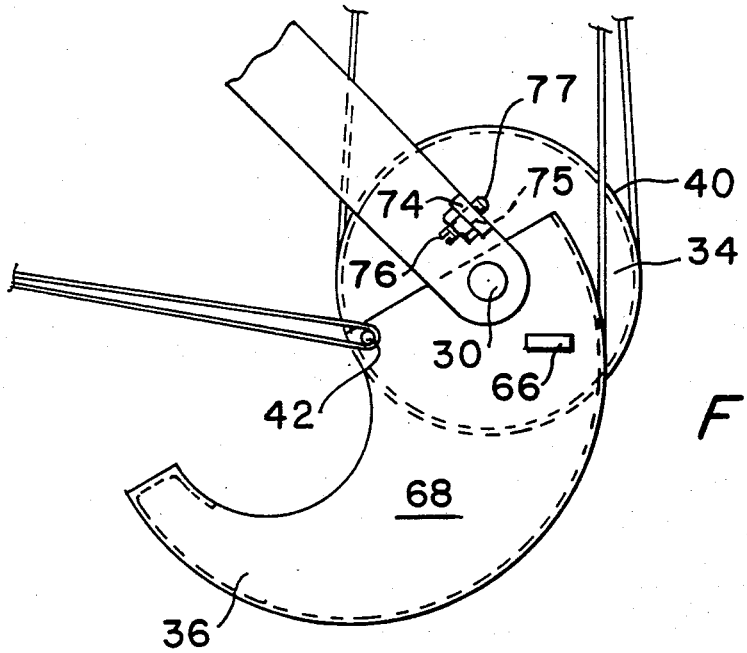
FIG. 4 is a fragmentary elevational view of one end of my bow assembly illustrating the structure in a relaxed position.
Figure 5:
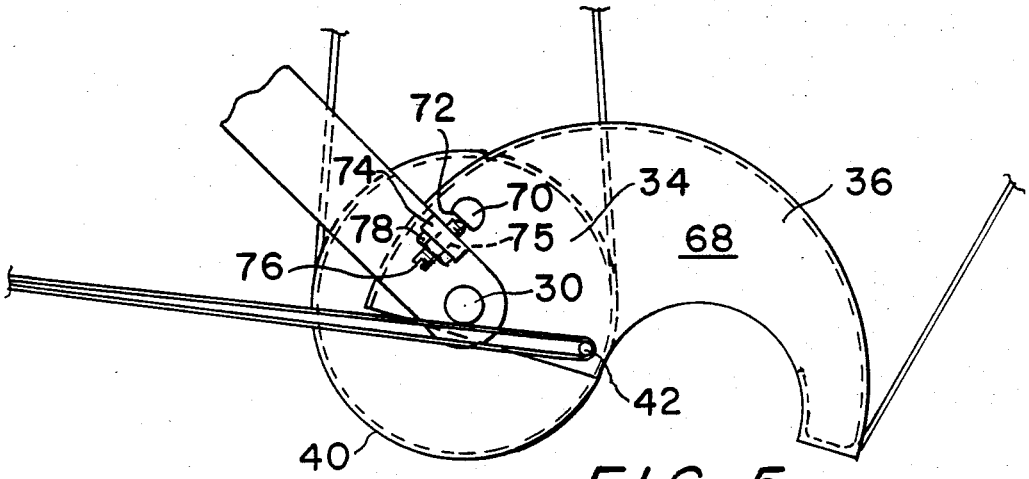
FIG. 5 is a fragmentary elevational view of showing a bow lever being rotated to a pulled shooting position.

The lever assemblies 26 and 28 as more specifically shown in FIGS. 4 and 5 each include a pulley 34 and a lever 36. The lever 36 can either be integral with the pulley 34 or they can be rigidly affixed for simultaneous rotation. Synchronizing cable 38 is received in grooves 40 of the respective pulleys 34 and is attached in a manner such that the two portions 38' and 38'' of the synchronizing cable 38 cross in the center at a point 39 illustrated in FIG. 2. The levers 36 each contain a connecting pin 42 that is rotatably mounted within the lever 36 by virtue of a conventional bearing assembly for a purpose to be later described.

Bow handle 12 has outwardly extending overlying flexible limbs 44 and 46 connected as shown in FIG. 1. The flexible limbs each terminate in free ends 48 and 50, the ends 48 and 50 having cable connection blocks 52 and 54 provided thereon. A force cable 56 is attached to each of the free ends 48 and 50 in the connecting blocks 52 and 54 and are positioned such that they loop the free ends 58 and 60 of the connecting pins 42 in grooves 62 and 64 on either side of the lever assemblies 26 as shown in FIG. 4. The grooves 62 and 64 are provided outwardly of portions 22 and 24 of the rigid limbs 14 and 16 which define the aforementioned cavaties 18 receiving the rotatable lever mechanisms.

As shown in FIGS. 4 and 5, the levers 36 are each provided with a molded flange 66 extending normally to the lever surface 68, illustrated in FIG. 5, or a pin 70 having a flat surface 72, illustrated in FIG. 5. One of the side portion 22 or 24 of the rigid limbs 14 and 16 are formed to include a laterally outwardly extending boss 74 containing a threaded aperture 75 receiving an adjustable stop screw 76. The screw 76 terminates in an end stop surface 77 which engages either the flange 66 or the pin 70 depending upon the structure utilized. The flange 66 can be molded upon the lever 36 or it and the pin 70 can be bar stock press-fit into apertures in the lever. In the latter configuration a weld obviously can be used if deemed necessary. Also as shown in FIG. 5, a lock nut 78 can be placed upon the adjustable screw 76 to secure the stop surface 77 in place. A bowstring 79 is connected to ends 80 and 82 of the levers 36 as shown in FIG. 2.

Figure 2:
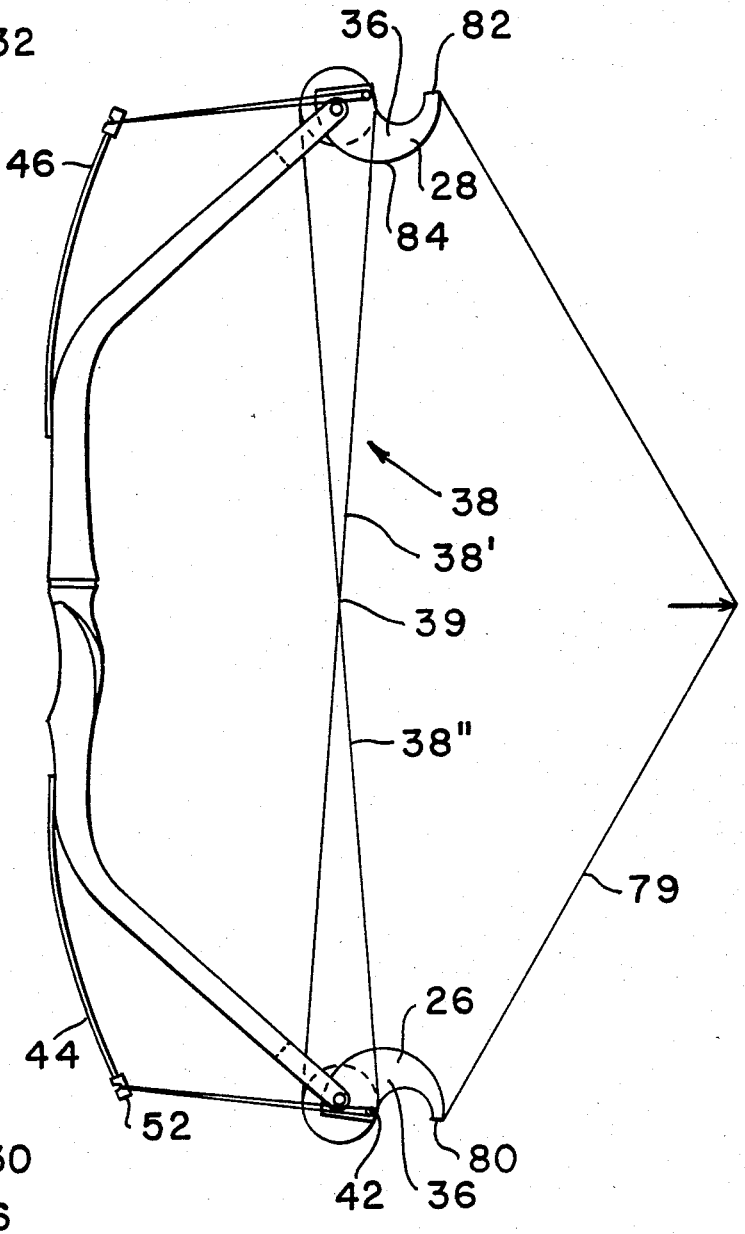
FIG. 2 is a side elevational view of my compound lever bow in a pulled shooting position.
Figure 3:
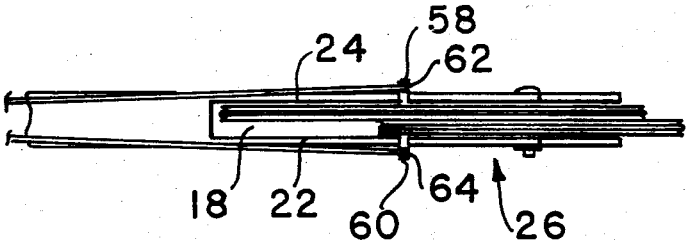
FIG. 3 is a magnified end elevational view of a compound lever bow structure of my invention shown in FIG. 1.

In operation, an archer pulls bowstring 79 to the position shown in FIG. 2. Movement of the lever assemblies 26 and 28. Rotation of flange 66 or the flat surface 72 of pin 70 against surface 77 of screw 76 prevents further movement of the levers 36. This prevents further pull against the force of the flexible limbs 44 and 46. The flexible limbs 44 and 46 are stressed against their inherent structural forces as shown in FIG. 2. Obviously the amount of structural force developed by the pull will depend upon the configuration and the composition of material used to form the flexible limbs 44 and 46 in combination with the amount of pull permitted by the stop screw 76.

The placement of the connecting pins 42 in levers 26 and 28 is crucial to the subject invention. The radial distance between pivot point 30 of the lever mechanism 26 and 28 and the rotating pin 42 receiving force cables 56 precisely regulates the mechanical advantage in my compound lever bow structure. The pre-determined mechanical advantage provided results in an initial relatively small pull force which gradually increases at a pre-determined slope to a relatively flat position during approximately the latter of two-thirds of the pull distance. The pull force then rapidly drops to a minimum hold force. This relationship is illustrated in a graph of FIG. 6. The stop screw 76 is positioned to limit the rotation of the levers 26 and 28 so that an over-centered situation does not develop. In other words as the force cables 56 are pulled with the rotation of the levers 26 and 28 such that the connecting pins 42, the pivoting point 30 and the connecting points 52 in FIG. 2 approach a straight line relationship the hold force rapidly approaches zero. The positioning of the stop screw 76 can be regulated to provide the archer with a pre-determined hold force of a magniture which permits ease of sighting and consequently very accurate shooting ability.

From the above description it is apparent that the flexible limbs 44 and 46 can be composed of any suitable material and can be configured to provide any particular shooting force. Also it is apparent that the connecting pins 42 can be located at any position in the levers 26 and 28 to provide a desired mechanical advantage. The combination of these elements are determinative of the final hold force and the shooting force of the bow structure. It is also readily apparent that this structure can be configured to suit the needs of a particular archer without any significant changes in concept of operation. With regard to the stop means, it is likewise apparent that any stop means configuration can be utilized to limit rotation of the levers 26 and 28.

Figure 6:
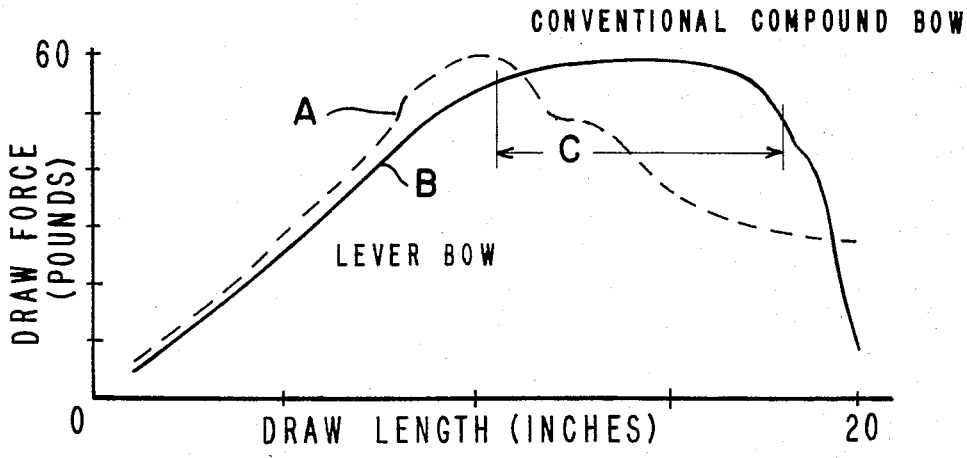
FIG. 6 is a graph illustrating the advantageous energy storing ability of my invention.

The mechanical advantage of my invention is vividly illustrated in FIG. 6 wherein the curve A defined by the broken lines is the usual force curve of a conventional compound bow. My lever bow develops curve B. In order to make a comparison of the energy storing abilities of the two structures, I have utilized a compound bow having a draw force essentially equal to the draw force of my lever bow structure so the two bows can be more readily compared in terms of force-draw efficiency. The pounds of draw force of each bow are plotted vertically while the amount of draw in inches is plotted horizontally. Consequently the area under the curve represents the energy each bow is capable of storing as it is drawn to a pulled firing position. The conventional compound bow as indicated again in the curve defined by the broken line A, yields a curve that rises to a maximum point and begins to slope down generally at the same rate that it assumed to its peak. On the negative slope side the area of the curve is reduced indicating the amount of the energy stored by the bow is also reduced. The actual curve shape B that my lever bow yields, on a force draw curve, is unique because of the plateau C of a draw force over an extended length of the pull indicating a substantial increase in energy storing ability. The curve clearly indicates an abrupt increase in pull force near the end of the pull length whereby it drops to a minimum hold force as determined by the setting of the stop screw 76. The total length of draw of my bow is determined by the length and contour of the levers 36 in combination with the length of the bow itself.

I claim:

1. A compound lever bow having a center handle and rigid bow limbs having free terminal ends; a lever mechanism rotatably mounted on a pivot point on each of said rigid bow limb terminal ends; said lever mechanisms each including a pulley portion and bowstring levers; said bowstring levers extending a predetermined distance radially outward of the pivot point of said lever mechanisms; a bowstring having respective ends connected to each of said bowstring levers; a synchronizing cable received by said pulley portions; flexible limbs having a strength providing a predetermined shooting force connected to opposite ends of said center handle and having free ends extending outwardly away from the handle; a force cable connecting pin mounted in each of said lever mechanisms; the pins being located a predetermined radial distance from the lever mechanism pivot point; a pair of force cables, each connected to respective of said connecting pins and said flexible limb free ends; and adjustable stop means on one of said rigid limbs in a position engaging said lever mechanism limiting rotation and preventing over-center rotation of said bowstring levers; the strength of said flexible limbs, the mechanical advantage provided by the radial distance between the bowstring lever pivot points and said connecting pins and the positioning of said adjustable stop means all combining whereby a specific bow shooting force is supplied in combination with a predetermined minimal shooting hold force.

2. A compound lever bow including a center handle and rigid bow limbs extending angularly from said handle; said rigid limbs having free terminal ends; a lever mechanism rotatably mounted at a pivot point on each of said rigid limb terminal ends; said lever mechanisms each including a pulley portion centrally mounted for rotation about said lever pivot point and also including arcuate bowstring levers integral with each of said pulley portions; said arcuate levers extending a pre-determined distance radially outward of the pivot mounting of each of said pulley portions; a bowstring connected to the outward ends of said arcuate levers; a synchronizing cable positioned on said pulley portions such that the synchronizing cable crosses itself in the middle of the bow; flexible limbs of a predetermined force ability connected to opposite ends of said center handle and extending outwardly in an overlying relationship with the associated rigid bow limbs; each of said flexible limbs having free terminal ends; a force cable connecting pin rotatably mounted in each of said arcuate levers at a predetermined location in relation to the rotatable mounting point of said lever mechanism; said cable connecting pins extending through said lever mechanisms outwardly a predetermined distance on either side of each of said arcuate lever; a force cable secured to each end of said connecting pins on opposite sides of said arcuate levers and to the terminal ends of each of said respective flexible limbs; said connecting pins in association with said pivot point of said lever mechanism providing a predetermined mechanical advantage as the bowstring is pulled to a shooting position; and an adjustable stop screw threadably positioned in a molded boss on at least one of said rigid limbs; said stop screw including a pivotally mounted brake pad positioned to tangentially engage an arcuate surface of one of said lever mechanisms for limiting rotation of the levers preventing an over-center condition when the pivot point of said lever mechanism, the force cable connecting pin, the lever pivot point, and the force cable connection point on said lever mechanism all approach a straight line relationship causing the shooting-hold force to approach a low near zero when the bowstring is pulled to the shooting position; said stop screw being precisely adjustable to regulate the low predetermined shooting-hold force.

3. A compound lever bow having a rigid handle and rigid bow limbs; lever mechanisms rotatably mounted on a pivot point on the ends of each of said rigid bow limbs; said lever mechanisms each including bowstring levers having free ends; said bowstring levers having a precise predetermined configuration placing said free ends a predetermined distance radially outward of said lever mechanism pivot points; a bowstring connected to the free ends of said bowstring levers and extending between each of said bowstring levers; said bowstring being movable between a relaxed position and pulled final firing positions; flexible limbs connected to said bow and overlying each one of said rigid bow limbs providing a terminal and overlying each rigid bow limb; force cable means connecting each flexible limb terminal end to a precisely positioned connection point located at a predetermined radial distance from said lever mechanism pivot point on each of said bowstring levers; and stop means on one of said bowstring levers operable between one of said rigid limbs and its associated bowstring lever; said stop means engaging said rigid limb preventing an over-center condition rendering the bow inoperable when said lever mechanism pivot point, said force cable means connection on said flexible limb terminal end and said force cable means connection point on said bowstring lever all move toward a straight line relationship relative to each other.

4. A compound lever bow having a rigid handle and rigid bow limbs; lever mechanisms rotatably mounted on a pivot point on the ends of each of said rigid bow limbs; said lever mechanisms each including a pulley portion and a bowstring lever having a free end; a synchronizing cable received by said pulleys for rotation in unison; said bowstring levers having a precise predetermined configuration placing said free ends a predetermined distance radially outward of said lever mechanism pivot point; a bowstring connected to the free ends of said bowstring levers and extending between each of said bowstring levers; said bowstring being movable between a relaxed position and pulled final firing positions; flexible limbs connected to said bow and overlying each one of said rigid bow limbs providing a terminal end overlying each rigid bow limb; force cable means connecting each flexible limb terminal end to a precisely positioned connection point located on each said lever at a predetermined radial distance from said lever mechanism pivot point, each of said bowstring levers providing a predetermined mechanical advantage on rotation of said bowstring levers; and stop means on one of said bowstring levers operable between one of said rigid limbs and its associated bowstring lever; said stop means engaging said rigid limb preventing an over-center condition rendering the bow inoperable when said lever mechanism pivot point, said force cable means connection on said flexible limb terminal end and said force cable means connection point on said bowstring lever all move toward a straight line relationship relative to each other.

* * * * *